United States Patent [19]

Bonazza et al.

[11] 4,269,606

[45] May 26, 1981

[54] FUEL AND LUBRICANT ADDITIVES FROM ACID TREATED MIXTURES OF VEGETABLE OIL DERIVED AMIDES AND ESTERS

[75] Inventors: Benedict R. Bonazza; Albert N. DeVault, both of Bartlesville, Okla.

[73] Assignee: Phillips Petroleum Company, Bartlesville, Okla.

[21] Appl. No.: 936,308

[22] Filed: Aug. 23, 1978

Related U.S. Application Data

[63] Continuation-in-part of Ser. No. 714,159, Aug. 13, 1976, abandoned.

[51] Int. Cl.[3] ..... C10L 1/22

[52] U.S. Cl. ..... 44/63; 252/51.5 A; 44/71; 260/401; 260/404.5

[58] Field of Search ..... 44/71, 63; 260/401, 260/404.5 PA; 252/33, 33.2, 51.5 A

[56] References Cited

U.S. PATENT DOCUMENTS

| | | | |
|---|---|---|---|
| 2,103,872 | 12/1937 | Schoeller et al. | 260/404.5 PA |
| 2,329,086 | 9/1943 | Robinson et al. | 260/401 |
| 2,345,632 | 4/1944 | Robinson et al. | 260/404.5 PA |
| 2,583,772 | 1/1952 | Gunderson | 260/401 |
| 3,438,898 | 4/1969 | Schlobohm | 252/33 |
| 3,752,657 | 8/1973 | Richardson | 44/78 |
| 4,173,456 | 11/1979 | Scheule et al. | |

FOREIGN PATENT DOCUMENTS

| | | | |
|---|---|---|---|
| 1558082 | 1/1969 | France | 252/33 |
| 195830 | 5/1938 | Switzerland | |
| 515882 | 12/1939 | United Kingdom | |

*Primary Examiner*—Patrick Garvin
*Assistant Examiner*—Y. Harris-Smith

[57] ABSTRACT

Vegetable oils such as corn oil, peanut oil, and soy oil are reacted with polyamines to form a mixture containing amides, imides, half esters, and glycerol with subsequent treatment with a strong acid such as sulfonic acid to produce a product mix that has good detergent properties in fuels and lubricants.

6 Claims, No Drawings

FUEL AND LUBRICANT ADDITIVES FROM ACID TREATED MIXTURES OF VEGETABLE OIL DERIVED AMIDES AND ESTERS

This application is a continuation-in-part of our copending application having Ser. No. 714,159 filed Aug. 13, 1976, now abandoned.

BACKGROUND OF THE INVENTION

This invention relates to additives for hydrocarbons suitable for use in an internal combustion engine. In one of its aspects this invention relates to detergent additives for hydrocarbon fuels. In another of its aspects this invention relates to detergent additives for hydrocarbon lubricants. In another of its aspects this invention relates to fuel detergent additives for use in hydrocarbon fuel in internal combustion engines. In yet another aspect of the invention it relates to mixtures containing a plurality of different functional moieties combining to produce superior qualities for fuel detergents and lubricant detergents.

With the advent of pollution standards for automobile exhausts it has become important that fuel additives not contain metal ions that tend to poison the catalyst in automotive engine exhaust converter systems. An additive mixture has now been discovered which does not contain metal ions and which performs well in a variety of detergency and gum deposit tests and which will also pass the water tolerance test (ASTM D 1094). The product mix is based on readily available vegetable oils and is therefore economically attractive.

It is therefore an object of this invention to provide additive mixtures for internal combustion engine fuels and lubricants containing multiple detergent functionalities. It is another object of this invention to provide a method for producing detergent additives for internal combustion engine fuels and lubricants. It is still another object of this invention to provide a detergent fuel composition combining a fuel detergent additive with a hydrocarbon suitable for use as fuel in an internal combustion engine. Other aspects, objects and the various advantages of this invention will become apparent upon reading this specification and the appended claims.

STATEMENT OF THE INVENTION

A method is provided for producing a detergent additive for fuels and lubricants combining multiple detergent functionalities in a product mixture by (1) reacting a vegetable oil with a multiamine to produce a product mixture that is then optionally, but preferably, (2) further reacted with sulfonic acid.

A mixture of product suitable as a detergent additive for lubricants and fuels is provided which is a composition of matter prepared by reacting a sulfonic acid with the product mixture obtained from the reaction of vegetable oil and a multiamine.

The vegetable oils may be selected from those commonly available such as cotton seed oil, peanut oil, soybean oil, corn oil, rapeseed oil, coconut oil, etc. These are mainly triglycerides of long chain monocarboxylic acids such as lauric, myristic, stearic, palmitic, palmitoleic, oleic, linoleic, etc., i.e., acids containing 10–25 carbon atoms:

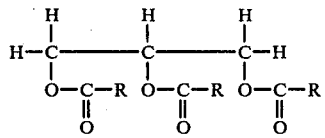

where R is an aliphatic radical of 10–25 carbon atoms.

Generally, oils contain glycerides of a number of acids, the number and kind varying with the source vegetable of the oil.

Among the multiamines that are suitable for use in this invention are those having the general formula $H_2N(CH_2CH_2NH)_xH$ where x is an integer between 2–10, preferably 3–6. Representative multiamines are ethylenediamine (EDA), tetraethylenepentamine (TEPA), pentaethylenehexamine (PEHA), etc. Mixtures of multiamines may be used. Polyethylenimine, among the amines preferred for use in this invention, is representative of a more complex group of multiamines.

The amounts of vegetable oil and multiamine employed can be expressed in terms of the molar ratio of triglyceride to Nitrogen (N). Broadly, the ratio is from 0.05:1 to 1.00:1 and preferably is from 0.13:1 to 0.80:1.

The first reaction, which is between the oil and a multiamine, results in a product that is a mixture of glycerol, glycerol partly esterified (mono and diglycerides), and amides and imidazolines of the fatty acids, e.g.,

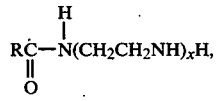

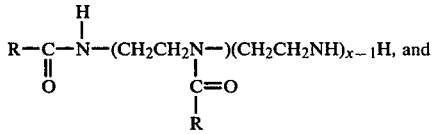

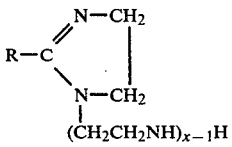

wherein x is as defined above. Reaction conditions for the first reaction are: temperature within the range of about 35° C. to about 260° C., preferably from about 120° C. to about 200° C., for a time of about 1 to about 16 hours, preferably about 4 to about 9 hours which can be carried out at atmospheric pressure, but is generally conducted at 0–50 psig when no diluent is present. If a diluent is employed the pressure is usually that produced by the vapor pressure of the diluent at the temperature employed. It is also preferable to utilize an inert atmosphere such as nitrogen over the reaction mixture. When tested, these product mixes were found to be effective detergent additives, but they generally could not pass the water tolerance test (ASTM D 1094 72).

However, treatment of the products of the first reaction with a strong acid, i.e., a sulfonic acid, produced additives with good detergency which also pass the water tolerance test. Suitable sulfonic acids have the general formula $R'SO_3H$ where R' is alkyl, aryl, alkaryl, cycloalkyl with 6–100 carbon atoms. Typically, dodecylbenzenesulfonic acid, octadecylsulfonic acid, dodecylsulfonic acid, and sulfonic acid oil can be used. The sulfonic acid mixture obtained by treating lubricating stock with sulfur trioxide, "mahogany" acid, etc., are also suitable for use in the second reaction.

The treatment of products of the first reaction with a strong acid is a neutralization reaction which takes place at atmospheric pressure. The reaction mixture requires stirring until homogeneity is achieved which usually requires from about 1 to about 300 minutes, more generally about 60 to about 120 minutes, with heat applied mostly for the purpose of reducing viscosity. The temperature is generally controlled within the range of about 25° to about 100° C., preferably about 40° to about 70° C.

The acid reacts preferentially with the amino groups remaining in the multiamines after the first reaction.

Normally liquid hydrocarbon diluents can be utilized in either the first or second reactions or both. It is also possible to strip the diluent from the products of the first and second reaction and replace it with a different diluent. Hydrocarbon diluents useful in the above reaction can include aromatic hydrocarbons of 6 to about 10 carbon atoms per molecule such as benzene, toluene, the xylenes, or mixtures thereof. Lube stocks such as solvent refined paraffinic oils can also be used as diluents. Such hydrocarbon diluents, if employed, need not be separated from the final product but can serve as solvent or carrier for the detergent additive to provide a convenient method of handling the additive when blending with fuel or lubricant stocks.

The final product is quite complex and the distribution of possible reaction products depends upon the ratio of vegetable oil to multiamine. However, a large excess of the strong acid should be avoided because it is preferred to have a product with a pH greater than about 6.

The final product is a detergent additive which is used at about 1–100 lb./1000 barrels of fuel to prevent harmful carburetor and intake system deposits. The fuel can be any hydrocarbon useful as an internal combustion engine fuel, preferably hydrocarbon mixtures used in commercial fuel blends.

As noted above, it is convenient to handle the detergent additive in a solvent i.e., a carrier or vehicle, to provide an additive package for use in blending the additive with fuels or lubricant stocks. It is generally considered beneficial to include a minor amount of material which has demulsifier properties in the additive package in the present invention. Such a component, though preferred, is not essential to the deposit-inhibiting effect of the additives of the present invention. Any material which is compatible with motor fuels and which exhibits demulsification properties when utilized at relatively low levels such as 0.1–10, preferably 0.5–5, percent by weight based on the weight of the additive in the additive package can be used. Due to the low dosage of such material, it has no tendency to interfere with the deposit-inhibiting effects of the additive or the combustion characteristics of the motor fuel.

Illustrative of demulsifying agents suitable for use in the present invention, but not limited thereto, are the oxyalkylated alkylphenolformaldehyde polymers as disclosed in U.S. Pat. Nos. 2,499,367, 3,424,565 and 3,752,657.

The amount of solvent used in forming the additive package can vary widely with the lower end of the range being the minimum amount of solvent required to keep the additive and/or demulsifier in solution under conditions encountered in handling or storage. The upper end of the solvent content for the additive package is usually governed by considerations of economy. Solvent content can range as high as about 95% by weight based on total additive package, but will generally be in a range of about 20 to about 80 weight percent.

The additives of this invention also are found to be useful with lubricant stocks, particularly solvent refined, paraffinic lubricant stock having a viscosity index of 100 or above and a Saybolt Viscosity at 210° F. in the range of about 39 to about 100 SUS, preferably about 45 to about 75 SUS. Additives prepared using the higher molecular weight sulfonic acids ($R'NR'SO_3H$=50–100 carbon atoms) are especially attractive for use as lubricant stocks due to their higher oil solubility. Other additives commonly used in formulating lubricants, such as Viscosity Index improvers, antioxidants, and the like can be used in formulation with the additives of this invention without destroying the effectiveness of the additives.

EXAMPLE I

Samples were prepared from the materials detailed below using the following reaction conditions:

In the reaction between vegetable oil and polyamine, a stirred reactor equipped with reflux condenser was used. The reactants were charged to the flask and the mixture was heated to 310°–350° F. (150°–177° C.) for about 7–9 hours under a blanket of nitrogen or with nitrogen bubbling through the reaction mixture.

In the treatment with an acid the product of the reaction above was stirred in a heater with the sulfonic acid at about 50° C. for about ½ hour. At times a lubricant base stock was blended with the additive to decrease its viscosity.

The following materials were used in the quantities indicated with the vegetable oil weight normalized to 100 grams.

| SAMPLE | OIL | AMINE | $R'SO_3H$ | LUBE STOCK |
|---|---|---|---|---|
| 1 | 100 g. corn | 10 g. PEI(1) | 0 | 0 |
| 2 | " | 10 g. TEPA(2) | 0 | 0 |
| 3 | " | " | 35 g. acid oil(3) | 0 |
| 4 | " | " | 8.9 g. DBSA(4) | 0 |
| 5 | 100 g. rapeseed | 10 g. PEI | 0 | 0 |
| 6 | " | 15 g. PEI | 0 | 0 |
| 7 | " | 10 g. TEPA | 0 | 0 |
| 8 | 100 g. cotton seed | 10 g. PEI | 0 | 0 |
| 9 | " | 15 g. PEI | 0 | 0 |
| 10 | " | 10 g. TEPA | 0 | 0 |
| 11 | " | " | 16.5 g. DBSA | 0 |
| 12 | " | " | 17.4 g. dobanic acid(5) | 0 |
| 13 | 100 g. peanut | 10 g. PEI | 0 | 0 |

-continued

| SAMPLE | OIL | AMINE | R'SO$_3$H | LUBE STOCK |
|---|---|---|---|---|
| 14 | " | ;5 g. PEI | 0 | 0 |
| 15 | 100 g. soybean | 110 g. PEI | 0 | 0 |
| 16 | " | " | 67 g. acid oil | 45 g. |
| 17 | " | " | 16.5 g. DBSA | 0 |
| 18 | " | 5.3 g. TEPA | 0 | 0 |
| 19 | " | " | 39.3 g. acid oil | 26.1 g. |
| 20 | " | " | 7.8 g. DBSA | 0 |
| 21 | " | 10.0 g. TEPA | 0 | 0 |
| 22 | " | " | 34.7 g. acid oil | 0 |
| 23 | " | 10.7 g. TEPA | 0 | 0 |
| 24 | " | " | 61.1 g. acid oil | 40.7 g. |
| 25 | " | " | 12.2 g. DBSA | 0 |
| 26 | " | 20.9 g. TEPA | 0 | 0 |
| 27 | " | " | 152.9 g. acid oil | 101.9 g. |
| 28 | " | " | 30.4 g. DBSA | 0 |
| 29 | 100 g. coconut | 30.1 g. TEPA | 92.8 g. acid oil | 55.7 g. |
| 30 | " | 15.1 g. TEPA | 34.4 g. acid oil | 37.4 g. |

(1)PEI = polyethylenimine
(2)TEPA = tetraethylenepentamine
(3)Acid oil - paraffinic oil treated with $SO_3$ to form sulfonates of average mol. wt. 150-1000
(4)DBSA = dodecylbenzenesulfonic acid
(5)Dobanic acid - branched chain dodecylbenzenesulfonic acid (alkyl branched isomeric mix)

EXAMPLE II

The samples prepared in Example I were subjected to a series of tests in a fuel recipe at the additive concentration listed.

1. "Falcon Engine Test" 10 lbs./1000 bbl. (All additives containing acid oil were tested at 20 lbs./1000 bbl.).
2. Thin layer chromatography Test (TLC) for detergency. 19,000 lbs./1000 bbl.
3. Spray Gum Deposit (Thermal Stability Test, as noted in U.S. Pat. No. 3,919,094, column 11, line 10 et seq). 175 lbs./1000 bbl.
4. Water Tolerance Test (ASTM D 1094). 20 lbs./1000 bbl.

The results are tabulated below.

In the "Falcon Engine Test" the additive was added to the hydrocarbon fuel in the amount of 10 lbs. of additive per 1000 barrels of hydrocarbon fuel. In the "Falcon Engine Test" a premium base unleaded gasoline without additive as a control and with various additives for test purposes was used to power a 170 CID 6-cylinder Falcon engine. The engine was run for 23 hours at 1800 rpm and 11.4 bhp with continuous, noncyclic operation. About 0.5 cubic feet per minute ambient air was introduced through PCV valve below the carburetor and 3.2 cubic feet per minute of exhaust gas was recirculated unfiltered through the carburetor throttle bore. Intake air was filtered through the standard filter element. An SAE 10W-40 motor oil was used with the oil sump temperature maintained at 216°±4° F. The temperature of coolant out was maintained at 196°±5° F. and the intake air temperature was varied to control the temperature above the carburetor sleeve at 150°±2° F. The fuel flow was maintained at about 1.5 gallons per hour with the air/fuel ratio checked periodically but not controlled and the intake manifold vacuum recorded but not controlled.

The performance of a fuel or additive in this test was evaluated on the basis of deposits formed on a removable aluminum sleeve in the carburetor throat. Three or four differential weights were obtained between the weight of the sleeve at the start of the test and the weights after the test: (1) unwashed, and (2) n-heptane washed. Visual ratings of deposits were not used in the evaluation. The results of the evaluation of the control and test runs are tabulated below.

The TLC test procedure used in evaluating these fuel additives was as follows: Whatman No. 2 filter paper was cut into rectangular strips approximately 3.8 by 7.6 cm and marked with a pencil at a distance of 5.1 cm from the base edge. Carburetor type deposits obtained from a modified Falcon engine detergency test were applied to each strip in chloroform solution (~0.5μl) with a capillary drawn from a melting point tube as a spot (~1 mm in diameter) 9 mm from the base of the strip. To develop a chromatogram, a strip was placed spotted end down in an Eastman Chromagram developing jar (No. 13256) containing a solution of detergent in toluene, making sure that the spot is above the liquid level in the jar. The elution of the strip was allowed to proceed until the solvent front reached the mark at the top of the strip, at which time the developed chromatogram was removed from the jar, dried, and rated. A rating scale of 4 to 10 based upon how well the detergent moves the spot was used to represent very poor detergency to excellent detergency characteristics (2). Approximately 10 to 15 minutes were required for each determination.

Since carburetion detergents possess surfactant properties, fuels containing them often form undesirable emulsions when agitated in the presence of water. The Water Tolerance Test measures the amount of demulsifier which must be added to the additive-fuel blend to break the emulsions. The demulsifier used was a commercially available product (Oronite OGA-473). Samples were tested by ASTM Standard Method of Test for Water Reaction of Aviation Fuels (D-1094-72). The results were reported as the percent of demulsifier (based on amount of additive present) required to a pass (P) rating in the test. Additives which required low percentages of demulsifier were considered to have superior water tolerance characteristics and those requiring greater than 4% demulsifier were given a fail (F) rating.

| Sample | Falcon Engine Test % Improvement(2) | TLC (10 is best) | Spray Gum Test mg Deposit | Water Tolerance Test P or F | Water Tolerance Test % Demulsifier(1) |
|---|---|---|---|---|---|
| 1 | 78 | 8 | 0 | F | — |
| 2 | 65 | 7 | 0 | P | 2 |

-continued

| Sample | Falcon Engine Test % Improvement(2) | TLC (10 is best) | Spray Gum Test mg Deposit | Water Tolerance Test P or F | Water Tolerance Test % Demulsifier(1) |
|---|---|---|---|---|---|
| 3 | not run | 8 | 0 | P | 2 |
| 4 | not run | 9 | 0.4 | P | 1 |
| 5 | 90 | 7 | 0 | F | — |
| 6 | 97 | 7 | 0 | F | — |
| 7 | 69 | 8 | 0 | P | 4 |
| 8 | 88 | 8 | 0.1 | F | — |
| 9 | 100 | 8 | 1.2 | F | — |
| 10 | 63 | 8 | 0 | P | 2 |
| 11 | 68 | 9 | 0 | P | 1 |
| 12 | 74 | 9 | 0 | P | 1 |
| 13 | 92 | 7 | 0 | F | — |
| 14 | 92 | 7 | 0.1 | F | — |
| 15 | 97 | 8 | 0 | F | — |
| 16 | 61 | 7 | not run | P | 1 |
| 17 | 75 | 8 | 0 | P | 1 |
| 18 | 65 | 7 | 0.6 | P | 1 |
| 19 | 75 | 7 | 0 | P | 0.5 |
| 20 | 66 | 8 | 0 | P | 0.5 |
| 21 | 68 | 8 | 0 | P | 1 |
| 22 | 78 | 8 | 0 | P | 0.7 |
| 23 | 66 | 8 | 0 | P | 0.5 |
| 24 | 75 | 8 | 0.5 | P | 0.5 |
| 25 | 67 | 9 | 0.2 | P | 0.5 |
| 26 | 83 | 8 | 0 | F | — |
| 27 | 79 | 8 | 0.3 | P | 0.5 |
| 28 | 78 | 8 | 1.5 | P | 1 |
| 29 | 82 | 8 | 0 | P(3) | 4 |
| 30 | 83 | 9 | 0.2 | P(3) | 1 |

(1)Wt. % of demulsifier based on weight of additive required to give Pass (P) rating. If more than 4% is needed, the test is scored Fail (F).
(2)Based on unwashed deposits.
(3)Tested at 40lbs/100bbl.

The data show that all the materials are good detergents in fuel compositions and that the treatment of additives containing polyethylenimine with sulfonic acid resulted in passing of the water tolerance test by the treated additives where the untreated additives had not passed the water tolerance test. In general, however, treatment with sulfonic acids improved the water tolerance of additives.

EXAMPLE III

The mono- and diglycerides formed during this reaction also contribute to the detergency of the product, whereas, the vegetable oils themselves (triglycerides) exhibit relatively little detergency. TLC results for glyceryl mono-, di-, and trioleate are tabulated below. The materials tested were commercially available products from Pfaltz and Bauer, Inc., Stamford, Conn., and were not prepared by the inventors.

| Glyceride | TLC (10 is best) |
|---|---|
| Monooleate | 8 |
| Dioleate | 6 |
| Trioleate | 4 |

The data show that the detergency quality decreases as more of the glycerol OH groups are esterified.

In Example IV below prior art compounds produced by "classical" sulfonation methods such as set forth in U.S. Pat. Nos. 2,329,086 and 2,285,337 were compared with a compound prepared by the method of the present invention.

EXAMPLE IV

To prepare samples A, B, and C set forth in the table below 400 grams (0.453 mol) of soybean oil was placed in a 1000 milliliter 4-neck flask, cooled in an ice water bath and equipped with a mechanical stirrer, condensor, thermometer, and addition funnel. The flask had been preflushed and was blanketed with $N_2$. 120 grams of concentrated $H_2SO_4$ (DuPont Reagent Grade, 95–97%) was added slowly with rapid stirring. The addition was made over a 3 hour period with the temperature maintained at 10° C.±3° C. The mixture was rapidly stirred for another 2 hours and during the second hour the temperature was allowed to rise to room temperature. The reaction mixture was then allowed to stand at room temperature. This reaction mixture will be called RM-1 here and below.

To produce sample A, 181.8 grams of RM-1 and 300 milliliters of 15% $Na_2SO_4$ were placed in a 1000 milliliter beaker and mechanically agitated. An emulsion formed which was warmed in a separatory funnel to 50°–60° C. with hot water and allowed to stand. An aqueous lower layer formed of which 140 milliliters were removed, the product was then washed with 200 milliliters of 15% $Na_2SO_4$ and then washed with 100 milliliters of a standard $NaHCO_3$ solution. 277.0 grams of this material was treated to evaporate volatiles to obtain 123.9 grams of a yellow semi-crystalline material. Approximately 120 grams of this material was stirred with 610 milliliters of isopropanol at about 60° C. for ½ hour. The solution was filtered while warm and the filtrate treated to evaporate volatiles to yield solids and an oil. The solids were rewashed with isopropanol and oil isolated from the washes was combined with the oil from the evaporative treatment with a total of 63.7 grams of oil product. 40.0 grams of this product was reacted with 12.2 grams of tetraethylenepentamine by heating the compounds together in a flask at 125° C. for 7 hours. The product which is denominated sample A was a yellow, semi-solid paste at room temperature.

For samples B and C 223.5 grams of the reaction product of soybean oil and sulfuric acid prepared as in sample A was dissolved in about 500 milliliters of isopropyl alcohol. This was rapidly stirred while 13 grams of $NH_3$ was bubbled through to obtain a pH of 7.80. Solids formed upon introduction of the $NH_3$. The solution was filtered and solids were washed with 300 milliliters of isopropyl alcohol and refiltered. The filtrates were combined and isopropyl alcohol was removed by evaporation to yield 200.2 grams of oil. This reaction product was then divided with 80 grams of the reaction mixture being contacted with 26.8 grams of tetraethylenepentamine in a flask heated to 125° C. for 7 hours to produce a very viscous, semi-solid oil with a dark brown mahogany color, denominated sample B, and 80 grams of the reaction mixture was reacted with 49.0 grams of tetraethylenepentamine in a flask heated to 125° C. for 7 hours to produce a viscous brown oil, denominated sample C. These samples were made to illustrate possible differences in reaction product caused by differences in ratio of the amine and sulfonated soy reactants.

The D sample was produced by mixing 794.4 grams soybean oil with 170.1 grams of tetraethylene pentamine in a flask, heating the mixture to 175° C. and controlling the reaction temperature there for 8 hours. To 200 grams of this reaction product was added 50 grams of concentrated $H_2SO_4$ (Dupont Reagent Grade 95–97%). The acid was added slowly with stirring and with the temperature maintained between 10° and 20° C. with an ice-water bath. After adding about 14 milliliters of the acid the reaction mixture became so viscous that the addition of 200 milliliters of tetrahydrofuran was necessary to allow the addition of the remainder of the acid. This reaction product was allowed to stand overnight and 15.3 grams of ammonia was bubbled through the reaction product to obtain a pH of 7.6. The tetrahydrofuran was removed by evaporation and the solids dissolved in 500 milliliters of isopropanol. A total of 208.6 grams of dark brown, clear oil was obtained as product, denominated sample D, by evaporating isopropanol, rewashing with isopropanol, and combining filtrates from the washings.

To obtain sample E, 550 grams of the product obtained by reaction of soybean oil and tetraethylenepentamine set out above in sample D was contacted with 371.0 grams of acid oil in a neutralization reaction by the process of this invention as set out in the examples above maintaining the temperature at 60°-70° C. for 45 minutes. The product was denominated sample E.

Each of the samples was subjected to elemental analysis, tests of solubility in n-heptane, and the Spray Gum Test, as set out in the examples above. The results of these tests are tabulated below.

TABLE

| Sample | Elemental Analyses C | H | N | S | N/S | Wt. % Solids in n-$C_7$ | Spray Gum Test (mg Deposits) |
|---|---|---|---|---|---|---|---|
| A | 63.31 | 10.65 | 8.04 | 1.70 | 4.73 | 112.8(1) | — |
| B | 63.43 | 10.82 | 8.84 | 1.87 | 4.73 | 106.1(1) | — |
| C | 62.06 | 11.16 | 13.35 | 1.44 | 9.27 | 101.1(1) | — |
| D | 67.90 | 11.04 | 5.49 | 0.56 | 9.80 | 0.0(2) | 16.3 |
| E | 76.12 | 11.75 | 3.76 | 0.67 | 5.61 | 0.1(2) | 0.0 |

(1)These products are insoluble. A small amount of solvent may not have been removed resulting in percentages greater than 100.
(2)These samples essentially completely soluble.

The data in this table show that products produced by the method of this invention are soluble in a hydrocarbon such as normal heptane and will pass the Spray Gum Test for deposition determination, while similar products made by the process of the prior art either are not soluble in normal heptane or, if soluble, will not pass the Spray Gum Test so that these products are shown to be of little use as an additive to a fuel or a lubricant for the purpose of detergent action.

We claim:

1. A composition useful as a detergent additive package for lubricants and fuels prepared by reacting multiamine with vegetable oil to obtain a product mixture, said vegetable oil selected from among triglycerides of long chain monocarboxylic acids of the formula

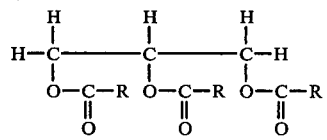

wherein R is an aliphatic radical of about 10 to about 25 carbon atoms said product mixture dissolved in an amount of hydrocarbon solvent sufficient to maintain said product mixture in solution.

2. A composition of claim 1 wherein the multiamines have the general formula $H_2N(CH_2CH_2NH)_xH$ where x is an integer between 2 and 10.

3. A composition of claim 1 wherein said vegetable oils are selected from among the group consisting of cotton seed oil, peanut oil, soybean oil, corn oil, rapeseed oil, and coconut oil.

4. A composition of claim 1 wherein said multiamine is polyethyleneimine.

5. An additive package useful as detergent additive for lubricants and fuels comprising a composition of claim 1 and a demulsifier.

6. A method for reducing engine deposits in an internal combustion engine comprising the addition of a detergent fuel additive package of claim 1 to the hydrocarbon fuel for the engine, said fuel detergent being added in an amount effective to reduce engine deposits and using said hydrocarbon fuel with fuel detergent additive as fuel in an internal combustion engine.

* * * * *